US005934266A

United States Patent [19]

Martin et al.

[11] Patent Number: 5,934,266

[45] Date of Patent: Aug. 10, 1999

[54] ARCHERY BOWS WITH STABILIZER RECEIVERS, AND STABILIZER RECEIVERS CONFIGURED FOR MOUNTING ARCHERY BOW STABILIZERS IN VARIABLE POSITIONS RELATIVE TO ARCHERY BOWS

[75] Inventors: Terry G. Martin, Walla Walla, Wash.; George T. Newbold, Milton-Freewater, Oreg.

[73] Assignee: Martin Archery, Inc., Walla Walla, Wash.

[21] Appl. No.: 08/831,710

[22] Filed: Apr. 7, 1997

Related U.S. Application Data

[63] Continuation-in-part of application No. 08/775,899, Jan. 2, 1997, Pat. No. 5,803,070.

[51] Int. Cl.[6] ..... F41B 5/14; F41B 5/20

[52] U.S. Cl. ..... 124/88; 124/89

[58] Field of Search ..... 124/23.1, 86, 88, 124/89

[56] References Cited

U.S. PATENT DOCUMENTS

| | | | |
|---|---|---|---|
| 3,196,860 | 7/1965 | Hoyt | 124/89 |
| 3,412,725 | 11/1968 | Hoyt | 124/89 |
| 3,502,062 | 3/1970 | Shurts | 124/23.1 |
| 3,524,441 | 8/1970 | Jeffery | 124/89 |
| 3,525,322 | 8/1970 | Lee . | |
| 3,589,350 | 6/1971 | Hoyt et al. | 124/89 |
| 3,752,142 | 8/1973 | Morita et al. . | |
| 3,804,072 | 4/1974 | Izuta . | |
| 3,840,944 | 10/1974 | Gresley | 124/88 X |
| 4,054,121 | 10/1977 | Hoyt | 124/89 |
| 4,296,725 | 10/1981 | Broderick . | |
| 4,324,222 | 4/1982 | Gasser | 124/89 |
| 4,491,123 | 1/1985 | Wirtz | 124/89 |
| 4,553,522 | 11/1985 | Topping | 124/89 |
| 4,556,042 | 12/1985 | Izuta | 124/89 |
| 4,615,327 | 10/1986 | Saunders | 124/89 |
| 4,643,159 | 2/1987 | Ryan . | |
| 4,787,361 | 11/1988 | Vyprachticky | 124/88 |
| 4,889,102 | 12/1989 | Martin | 124/88 |
| 5,178,122 | 1/1993 | Simonds | 124/89 X |
| 5,419,304 | 5/1995 | Pardue | 124/86 |
| 5,433,792 | 7/1995 | Darlington | 124/25.6 |
| 5,535,731 | 7/1996 | Webster | 124/89 |
| 5,558,078 | 9/1996 | Dunlap | 124/89 |
| 5,619,981 | 4/1997 | Breedlove | 124/89 |
| 5,649,527 | 7/1997 | Olsen et al. | 124/89 |
| 5,657,741 | 8/1997 | Todd | 124/89 |

*Primary Examiner*—John A. Ricci

*Attorney, Agent, or Firm*—Wells, St. John, Roberts, Gregory & Matkin, P.S.

[57] ABSTRACT

The invention encompasses archery bows with stabilizer receivers and archery bow stabilizer receivers. In one aspect, the invention includes an archery bow handle defining a major longitudinal handle axis comprising: a) a handle body; b) a first end of the handle body; c) a second end of the handle body longitudinally displaced from the first end; d) a handgrip portion positioned longitudinally between the first and second ends and configured to be grasped by an archer's hand; e) a stabilizer receiver displaced from the handgrip portion and configured to receive an archery bow stabilizer, the stabilizer receiver and the handgrip portion overlapping at a common longitudinal displacement from the first end, the stabilizer receiver being removably attached to the handle body; and f) a cavity between the stabilizer receiver and the handgrip portion, the cavity being sized to enable one or more of the fingers of the archer's hand to slide between the handgrip portion and the stabilizer receiver. In another aspect, the invention includes a stabilizer receiver comprising: a) a receiver body; b) an aperture extending into the receiver body and configured for receiving an archery bow stabilizer; c) a first orifice extending through the receiver body and configured for receiving a first pin; and d) a second orifice extending through the receiver body and configured for receiving a second pin.

36 Claims, 10 Drawing Sheets

ARCHERY BOWS WITH STABILIZER RECEIVERS, AND STABILIZER RECEIVERS CONFIGURED FOR MOUNTING ARCHERY BOW STABILIZERS IN VARIABLE POSITIONS RELATIVE TO ARCHERY BOWS

RELATED PATENT DATA

This application is a continuation-in-part of U.S. patent application Ser. No. 08/775,899 entitled "Archery Bows With Stabilizer Receivers, And Stabilizer Receivers Configured For Mounting Archery Bow Stabilizers In Variable Positions Relative To Archery Bows", filed on Jan. 2, 1997, now U.S. Pat. No. 5,803,070 and listing the inventors as Terry G. Martin and George T. Newbold.

TECHNICAL FIELD

This invention relates to archery bows, handles for archery bows, and stabilizer receivers for archery bows.

BACKGROUND OF THE INVENTION

Archery bows are typically constructed with an insert for attaching an archery bow stabilizer to the bow. Archery bow stabilizers are utilized to absorb limb vibration, add mass weight to a bow, and allow an archer to hold steadier on target by giving a desired balance to a bow. Target bow stabilizers up to three feet long are not uncommon, but hunting bow stabilizers are usually under 12 inches. Some hunting bow stabilizers may be used for storage of small accessories or survival gear.

It would be desirable to place an archery bow stabilizer near the center of an archery bow to provide optimum balance priorities. However, such desired placement of an archery bow stabilizer would place the bow stabilizer at an archer's handgrip, and would thus interfere with the archer's ability to grip the bow. Further, the optimal location of a stabilizer relative to an archery bow will depend upon characteristics of the bow, and characteristics of the archer.

Bows are frequently used for hunting. It is frequently desirable to have hunting bows be relatively short so that the bows do not get hung-up in brush as an archer is stalking prey. Stabilizers are currently typically mounted on a riser portion of an archery bow and offset relative to a handgrip portion of an archery bow. The riser portions must therefore be extended well beyond the handgrip portion to provide room to receive a stabilizer. Accordingly, it would be desirable to develop a mechanism for mounting a stabilizer whereby the stabilizer could overlap a handgrip portion and thus enable archery bow riser portions to be shortened.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In one aspect, the invention encompasses an archery bow handle defining a major longitudinal handle axis comprising:

a handle body;

a first end of the handle body;

a second end of the handle body longitudinally displaced from the first end;

a handgrip portion positioned longitudinally between the first and second ends and configured to be grasped by an archer's hand;

a stabilizer receiver displaced from the handgrip portion and configured to receive an archery bow stabilizer, the stabilizer receiver and the handgrip portion overlapping at a common longitudinal displacement from the first end, the stabilizer receiver being removably attached to the handle body; and a cavity between the stabilizer receiver and the handgrip portion, the cavity being sized to enable one or more of the fingers of the archer's hand to slide between the handgrip portion and the stabilizer receiver.

In another aspect, the invention encompasses an archery bow handle comprising:

a handle body;

a threaded aperture extending into the handle body;

a stabilizer receiver removably attached to the handle body;

an orifice extending through the stabilizer receiver;

a threaded bolt extending through the orifice of the stabilizer receiver and threadedly engaging the threaded aperture; and a rotation stop connected to both the stabilizer receiver and the handle body and configured to impede rotation of the stabilizer receiver relative to the handle body.

In yet another aspect, the invention encompasses a stabilizer receiver comprising:

a receiver body;

an aperture extending into the receiver body and configured for receiving an archery bow stabilizer;

a first orifice extending through the receiver body and configured for receiving a first pin; and a second orifice extending through the receiver body and configured for receiving a second pin.

In yet another aspect, the invention encompasses a stabilizer receiver system comprising:

an archery bow riser having a riser body, the archery bow riser comprising a first orifice within the riser body;

a stabilizer receiver having a receiver body and configured for detachably attaching to the riser body, the stabilizer receiver comprising a second orifice within the stabilizer receiver body;

a first pin extending within the first and second orifices; and a second pin extending from the stabilizer receiver to the archery bow riser.

Figure 1:
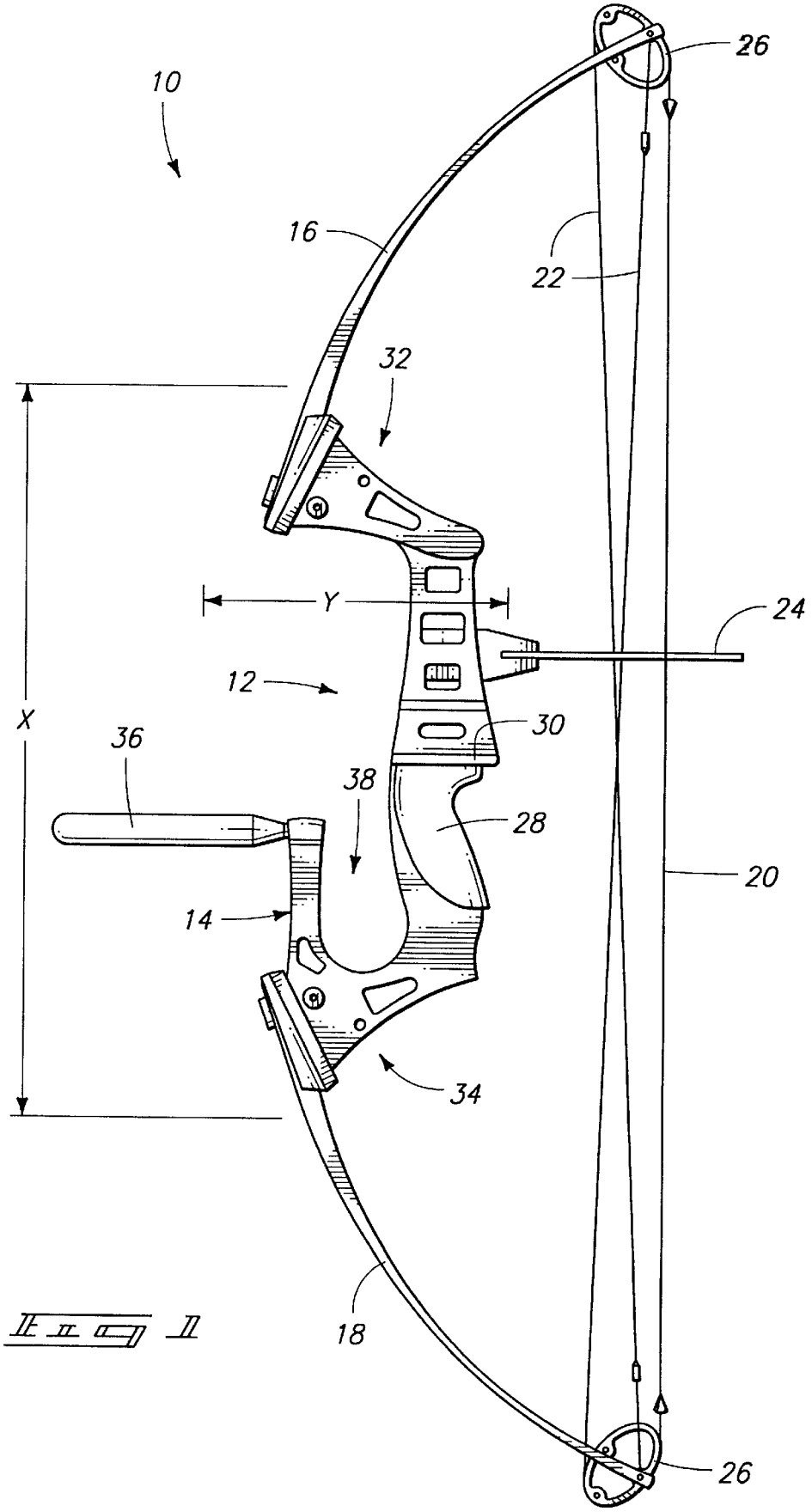
FIG. 1 is a side elevational view of an archery bow illustrating a first embodiment stabilizer receiver of the present invention.

Referring to FIG. 1 an archery bow 10 is illustrated. Archery bow 10 comprises a handle riser portion 12 and associated stabilizer receiver 14 constructed according to a first embodiment of the present invention. Bow 10 further comprises a top limb 16, a lower limb 18, a bow string 20, power cables 22, a cable guard assembly 24, and eccentric wheels 26.

Handle riser portion 12 comprises a handgrip portion 28 below a shelf 30. Handle riser portion 12 defines a major longitudinal axis "X" and a transverse axis "Y" extending perpendicularly to longitudinal axis "X." Handle riser portion 12 may alternatively be referred to as an archery bow handle 12.

Archery bow handle 12 comprises a first end 32 and a second end 34 longitudinally displaced from first end 32. Handgrip portion 28 is positioned longitudinally between first end 32 and second end 34, and is configured to be grasped by an archer's hand. Stabilizer receiver 14 is forwardly displaced from handgrip portion 28, with the direction "forwardly" being defined as a direction in which an arrow would be launched from bow 10. Stabilizer receiver 14 and handgrip portion 28 overlap at a common longitudinal displacement from first end 32. Stabilizer receiver 14 is configured to receive a stabilizer 36. Stabilizer receiver 14 preferably comprises a threaded aperture which matingly receives a threaded extension (not shown) of stabilizer 36. For example, receiver 14 may comprise a single threaded aperture similar to apertures 40 which are shown and described with reference to FIGS. 2 and 3 below regarding a second embodiment of the present invention.

A cavity 38 is between stabilizer receiver 14 and handgrip portion 28. Cavity 38 is ideally sized to enable one or more fingers of an archer's hand to slide between handgrip portion 28 and stabilizer receiver 14. In the shown preferred embodiment, stabilizer receiver 14 is integral with archer bow handle 12 and handgrip portion 28.

Stabilizer receiver 14 is laterally displaced forwardly of handgrip portion 28. Stabilizer receiver 14 can thereby advantageously permit placement of a stabilizer 36 in a configuration which overlaps handgrip portion 28 at a common longitudinal displacement from first end 32, and yet which does not interfere with an archer's ability to grasp or otherwise position their hand relative to handgrip portion 28. The longitudinal overlap of stabilizer 36 and handgrip portion 28 advantageously enables handle riser 12 to be shortened relative to prior art handle risers wherein a stabilizer receiver was placed above or below a handgrip portion.

Figure 2:
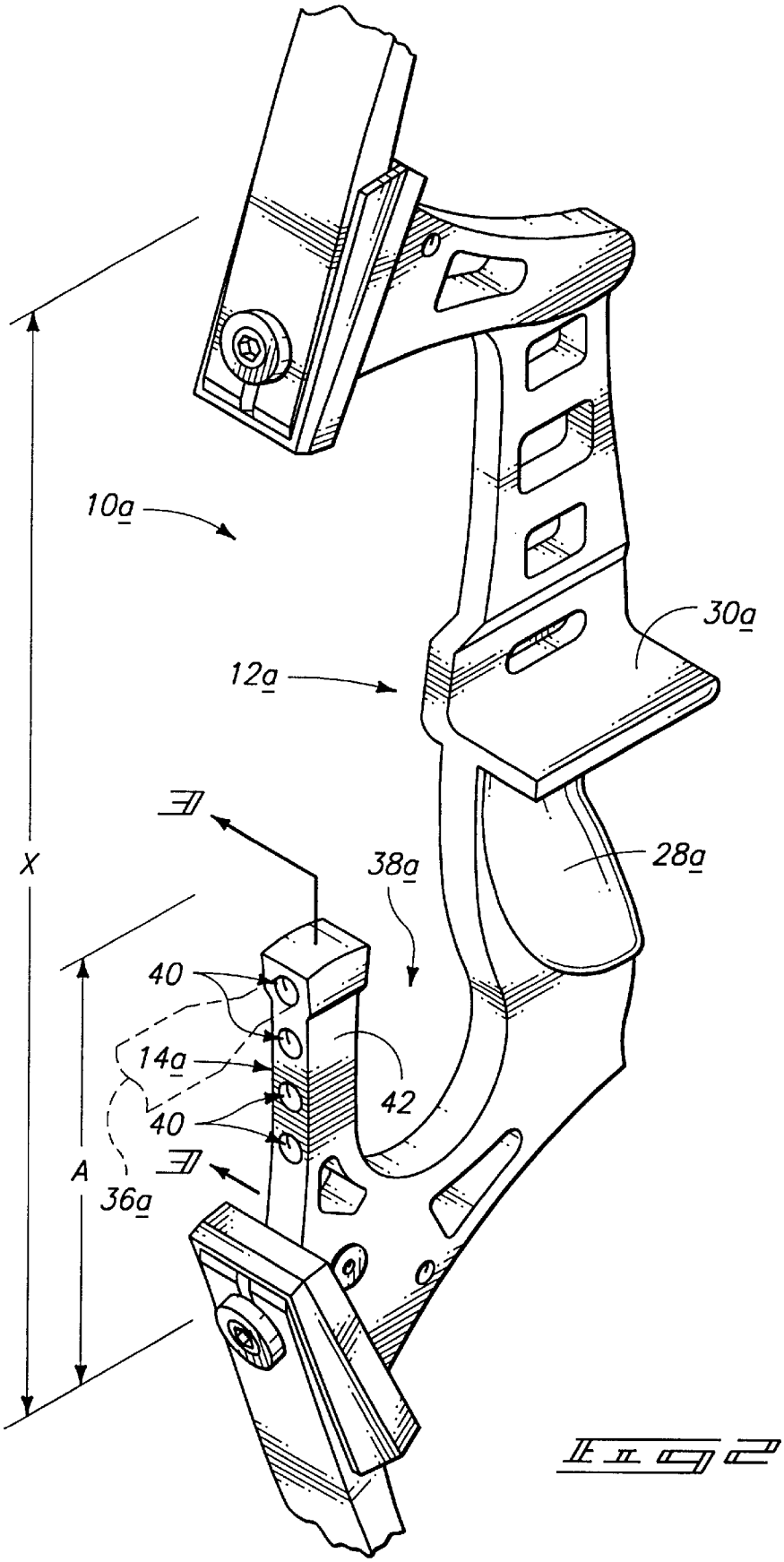
FIG. 2 is an enlarged fragmentary perspective view of a handle riser section of an archery bow illustrating a second embodiment of a stabilizer receiver of the present invention.
Figure 3:
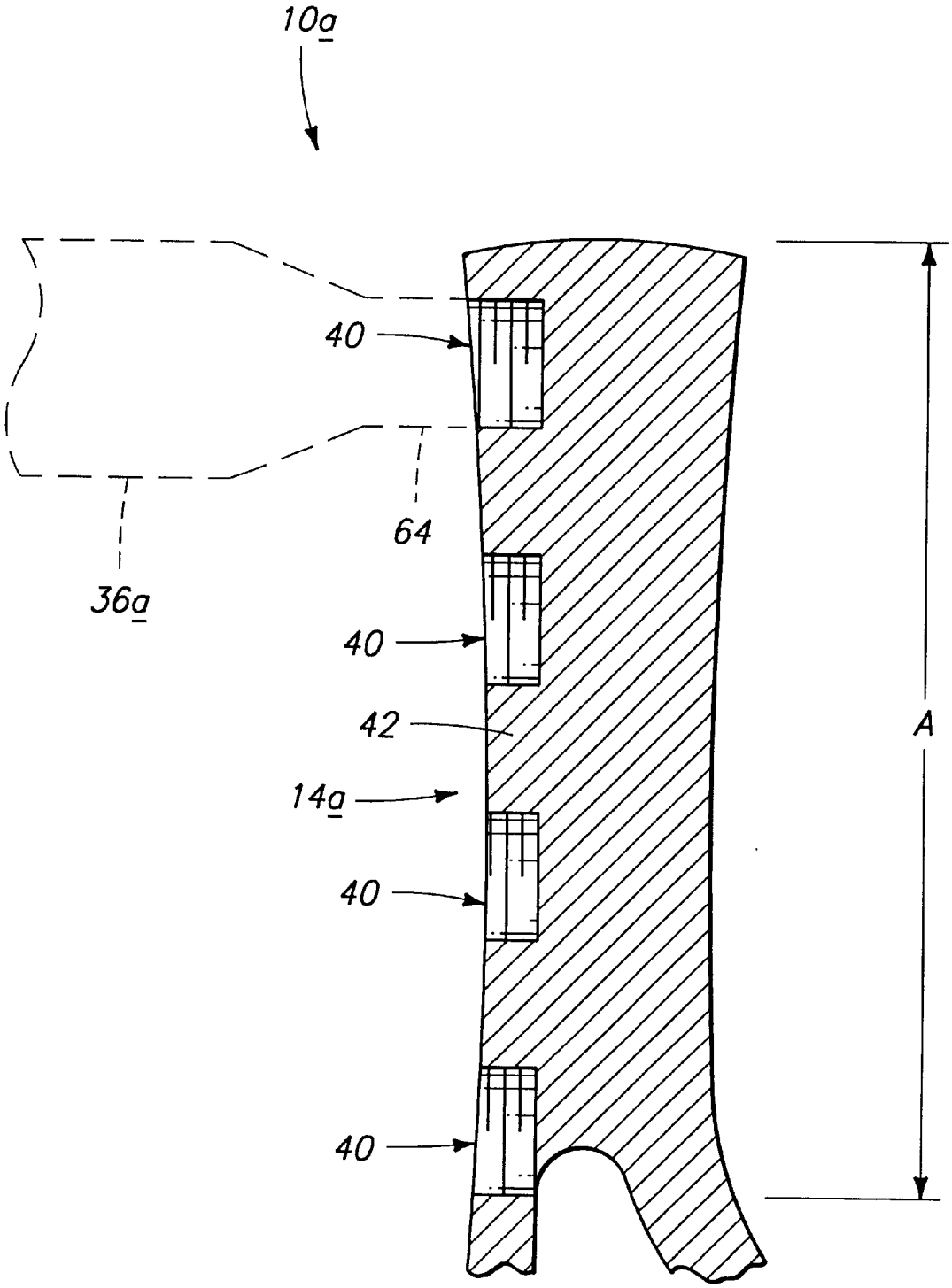
FIG. 3 is an enlarged fragmentary sectional side view along the line 3—3 of FIG. 2.
Figure 4:
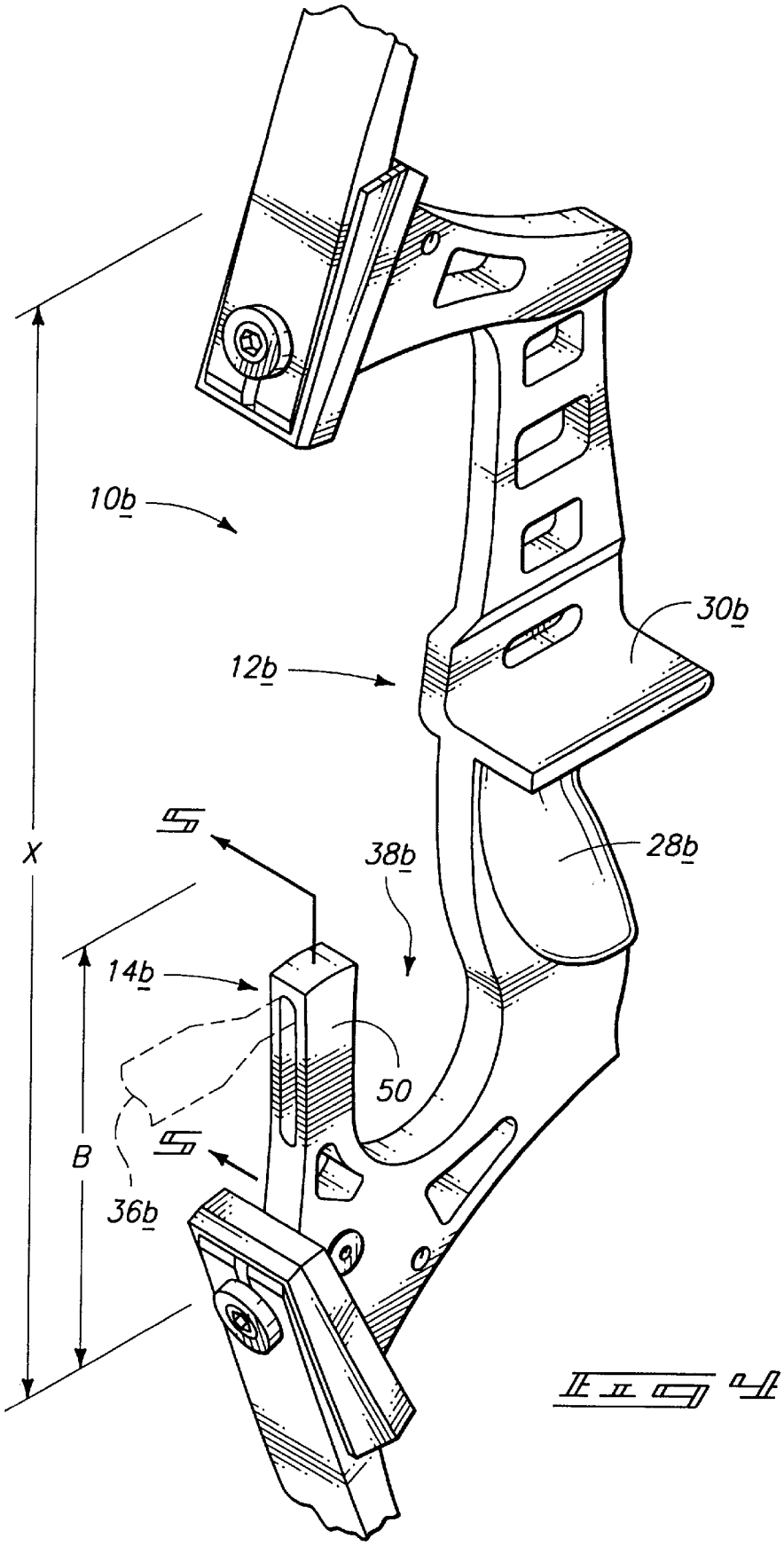
FIG. 4 is a fragmentary perspective view of a handle riser portion of an archery bow illustrating a third embodiment of a stabilizer receiver of the present invention.
Figure 5:
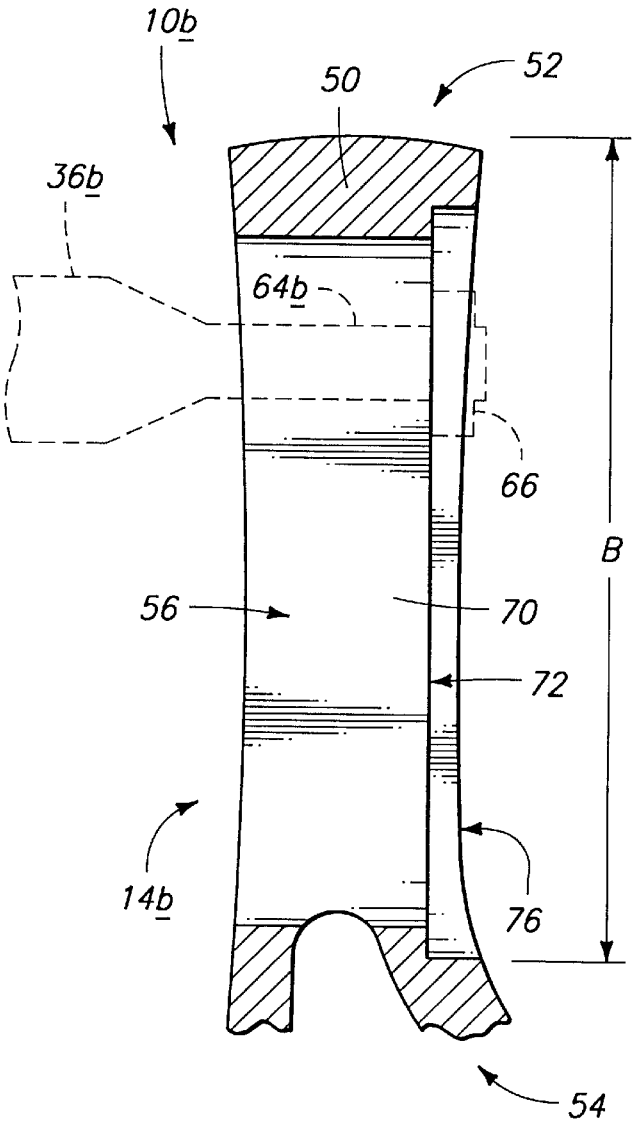
FIG. 5 is an enlarged fragmentary sectional side view along the line 5—5 of FIG. 4.
Figure 6:
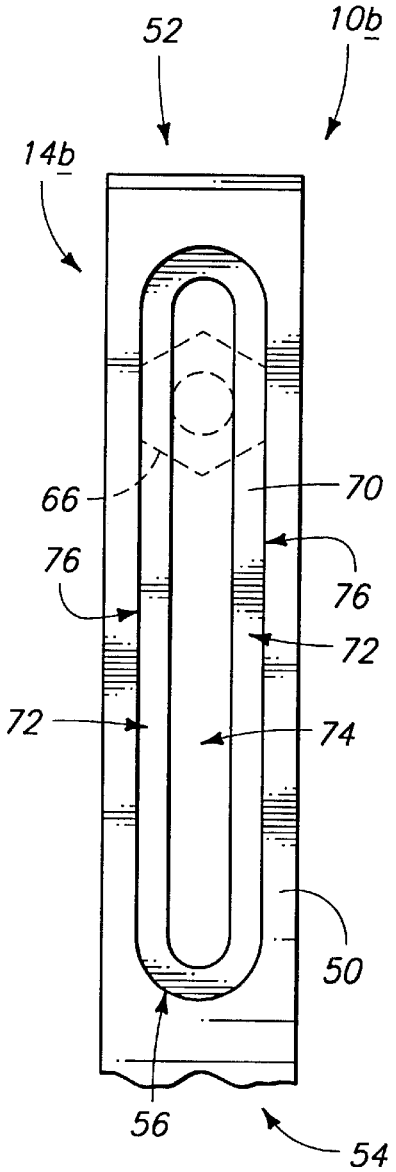
FIG. 6 is an enlarged fragmentary back view of the stabilizer receiver of FIG. 4.
Figure 7:
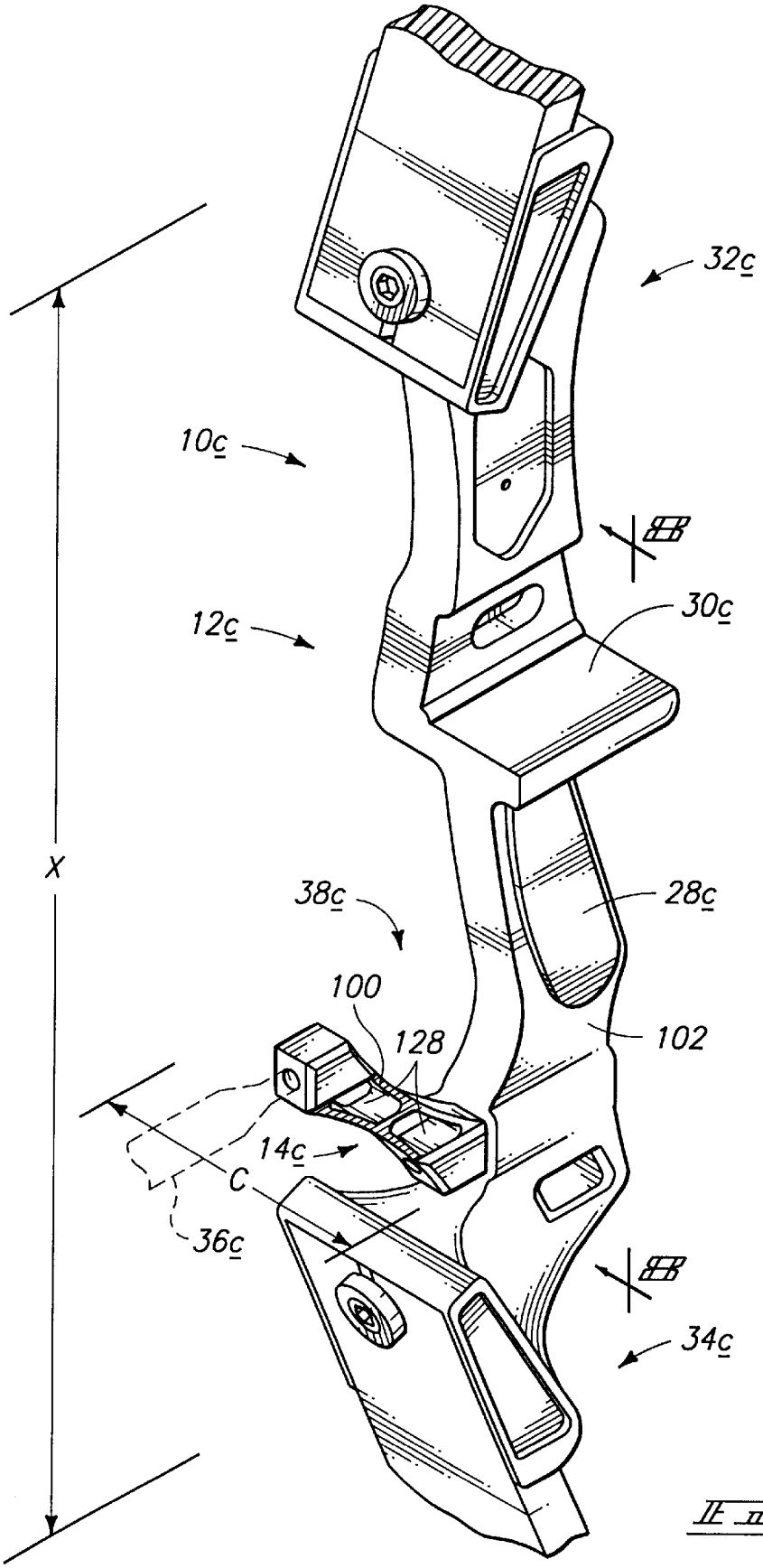
FIG. 7 is an enlarged fragmentary perspective view of a handle riser section of an archery bow illustrating a fourth embodiment of the present invention.
Figure 8:
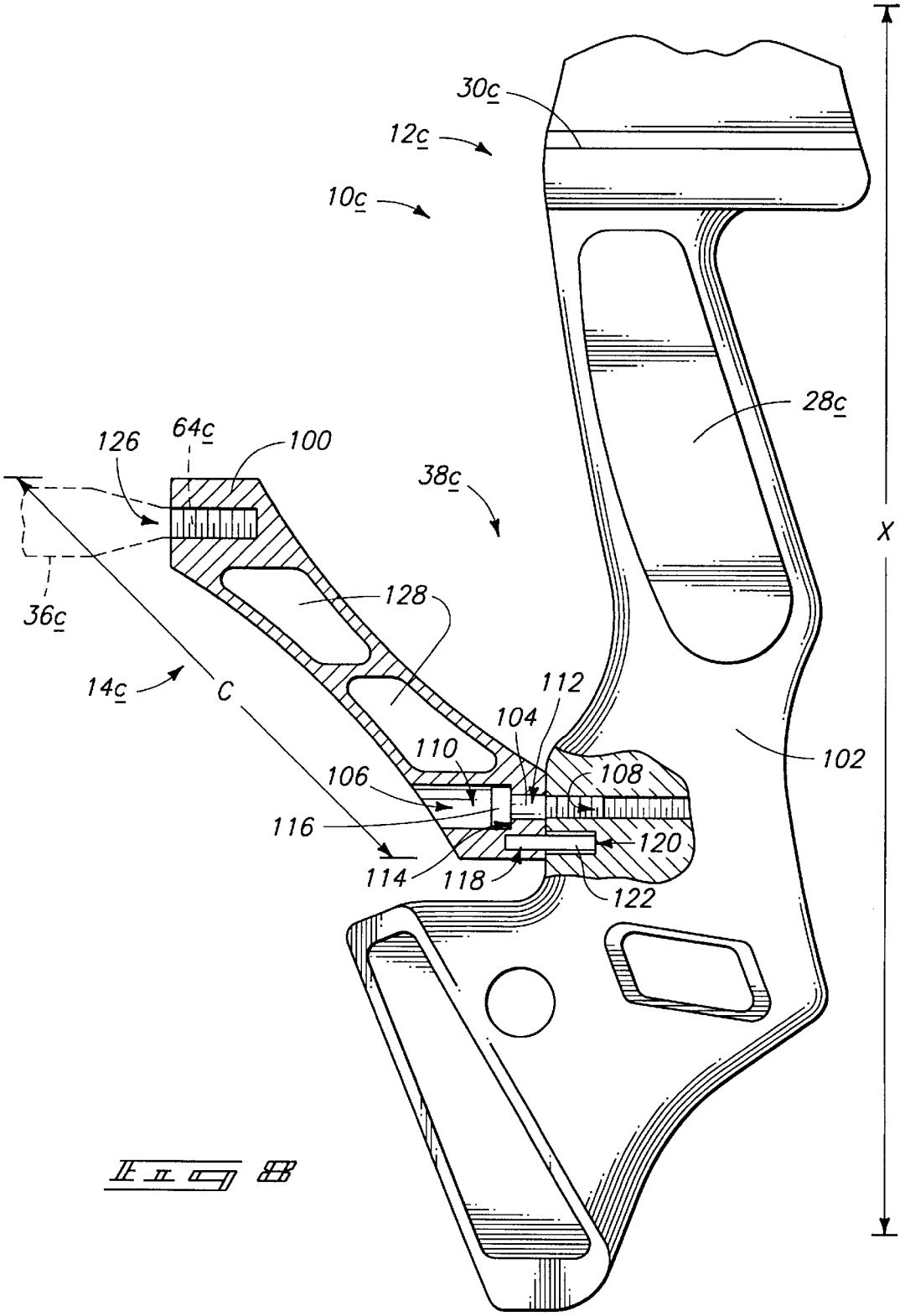
FIG. 8 is an enlarged fragmentary sectional side view along the line 8—8 of FIG. 7.
Figure 9:
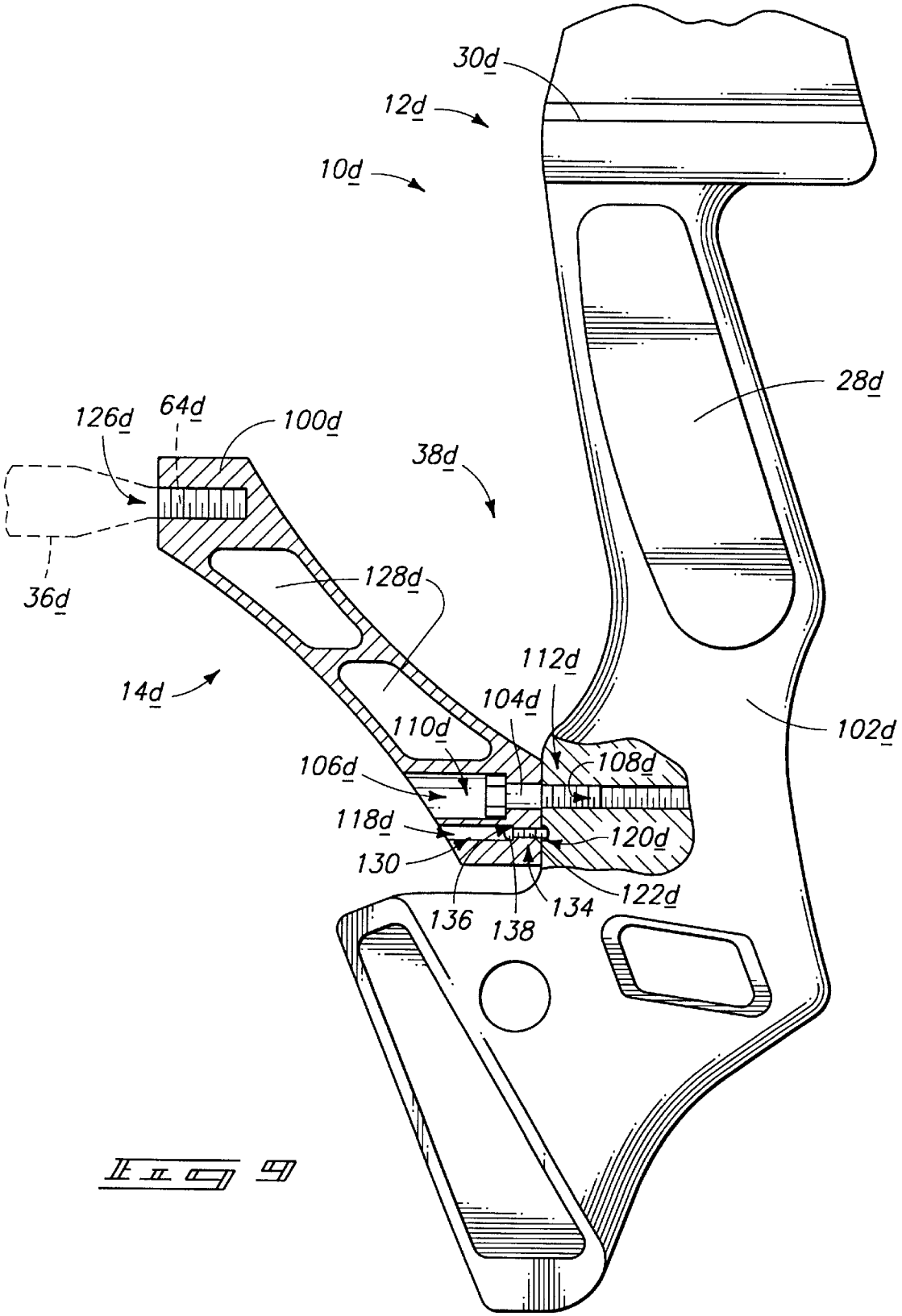
FIG. 9 is an enlarged fragmentary side view of a handle riser section of an archery bow illustrating a fifth embodiment of the present invention.
Figure 10:
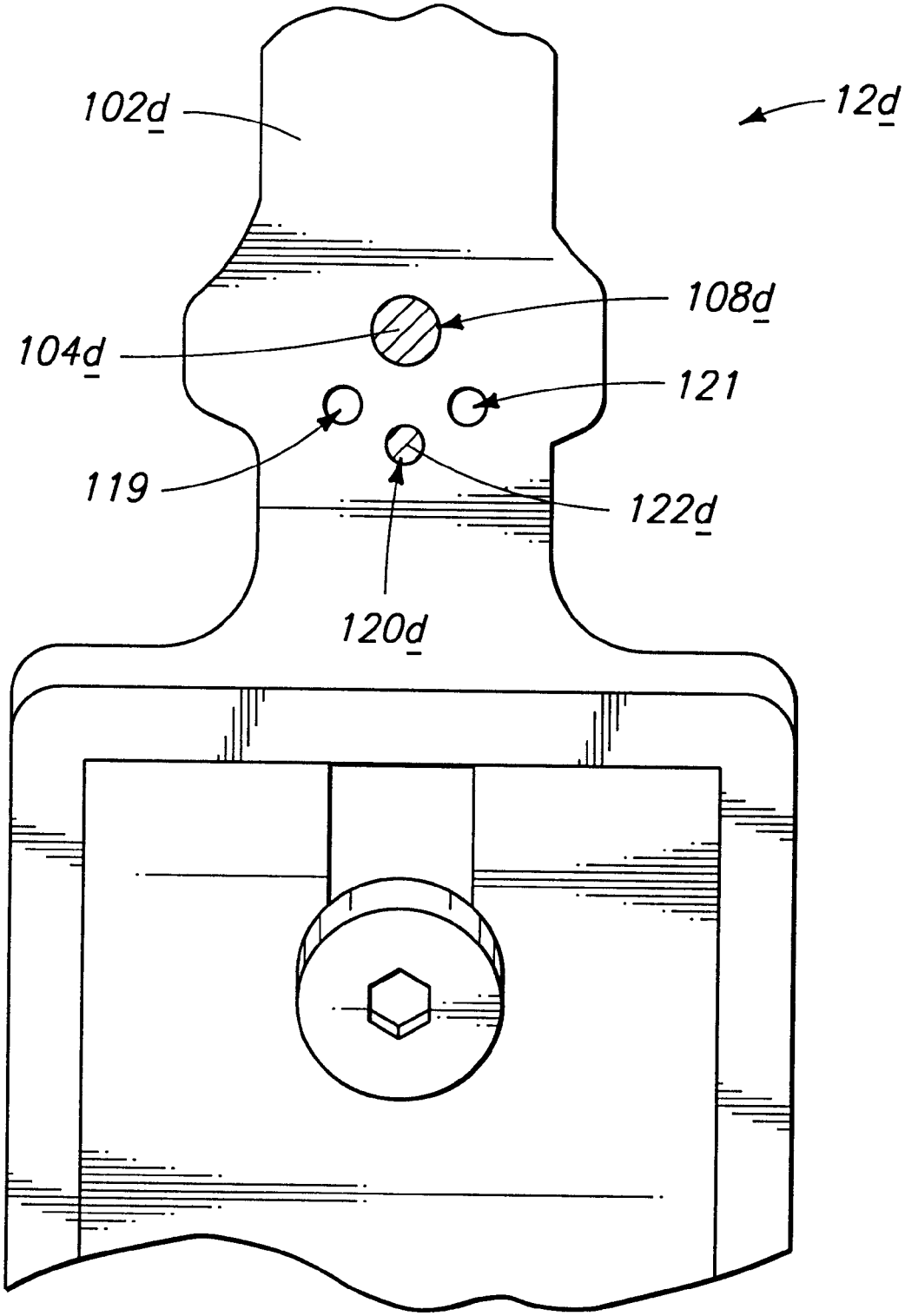
FIG. 10 is an enlarged fragmentary front view of the handle riser portion of FIG. 9.
Figure 11:
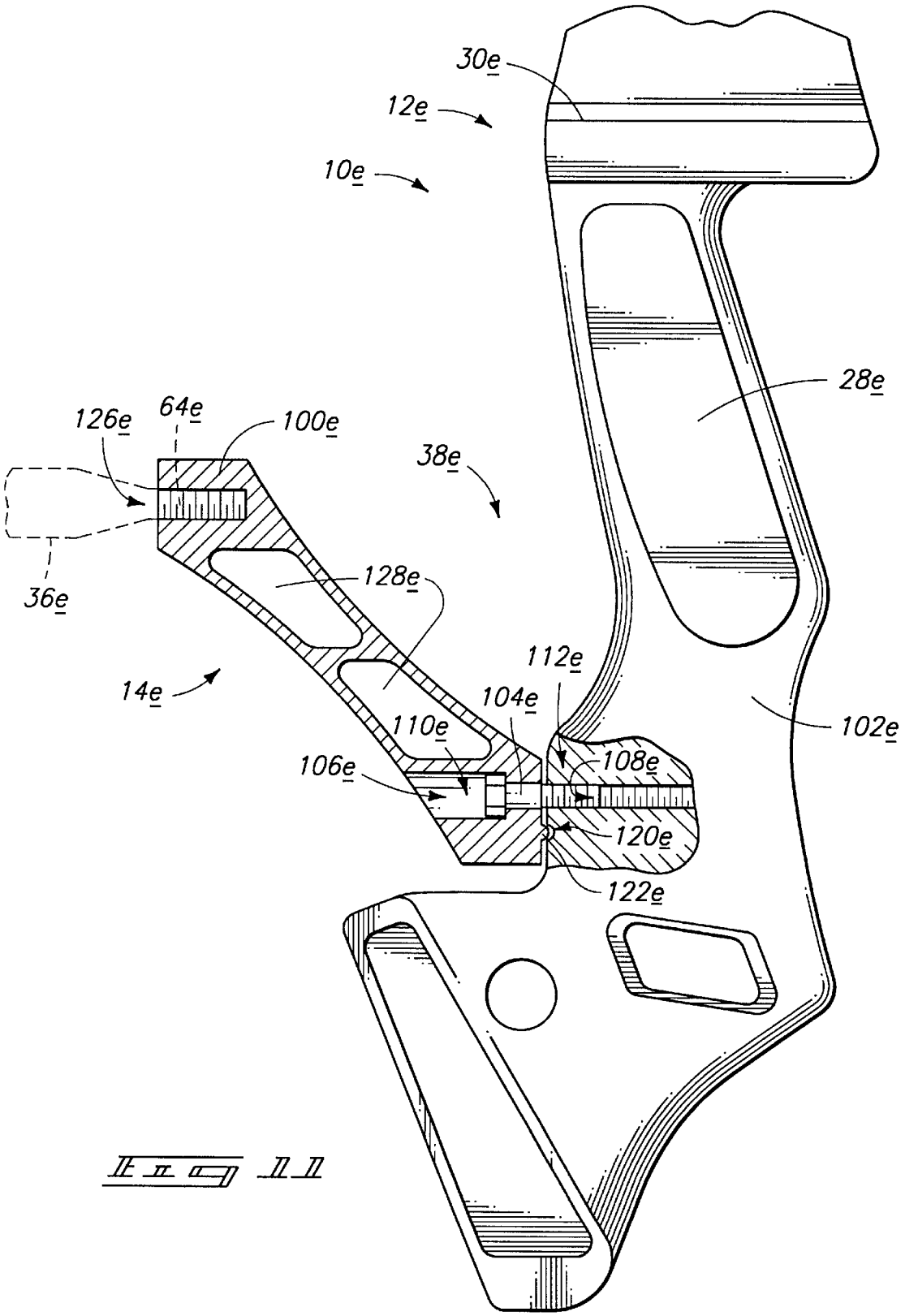
FIG. 11 is an enlarged fragmentary side view of a handle riser section of an archery bow illustrating a sixth embodiment of the present invention.

FIGS. 2–11 illustrate alternate embodiments of the present invention wherein a stabilizer receiver is configured for mounting an archery bow stabilizer in variable positions relative to an archery bow. FIGS. 2–3 illustrate a second embodiment of the present invention, FIGS. 4–6 illustrate a third embodiment of the present invention, FIGS. 7–8 illustrate a fourth embodiment of the present invention, FIGS. 9–10 illustrate a fifth embodiment of the present invention, and FIG. 11 illustrates a sixth embodiment of the present invention.

Referring to the second embodiment of FIGS. 2 and 3, like numerals from the preceding discussion of the first embodiment are utilized where appropriates with differences being indicated by the suffix "a" or with different numerals.

Archery bow 10*a* comprises a handle riser portion 12*a*. Handle riser portion 12*a* comprises a handgrip portion 28*a* and a shelf 30*a* above handgrip portion 28*a*. A stabilizer receiver 14*a* is forwardly displaced from handgrip portion 28*a*. A cavity 38*a* is between stabilizer receiver 14*a* and handgrip portion 28*a*. Stabilizer receiver 14*a* comprises a plurality of apertures 40 configured to permit variable positioning of an archery bow stabilizer received within stabilizer receiver 14*a*. Apertures 40 permit variable positioning of an archery bow stabilizer 36*a* (shown in phantom view).

Stabilizer receiver 14*a* comprises a body 42. Body 42 comprises a major longitudinal axis "A" which preferably substantially parallels major longitudinal axis "X" of handle riser portion 12*a*. Apertures 40 are displaced from one another along major longitudinal axis "A." Apertures 40 extend within body 42 and are configured to threadedly engage a threaded extension, such as the extension 64 of stabilizer 36*a*.

The second embodiment of the present invention permits variable positioning of a stabilizer relative to an archery bow. More specifically, the second embodiment of the present invention permits displacement of a stabilizer across a range of variable positions determined by apertures 40. However, the second embodiment of the present invention permits only discontinuous displacement across such range of variable positions. A third embodiment of the present invention, discussed below with reference to FIGS. 4–6, permits continuous displacement across a range of variable positions.

Referring to FIGS. 4–6, the third embodiment of the present invention is illustrated with like numerals from the preceding discussion of the first embodiment utilized where appropriate, with differences being indicated by the suffix "b" or with different numerals.

Archery bow 10*b* comprises a handle riser portion 12*b*. Handle riser portion 12*b* comprises a handgrip portion 28*b* and a shelf 30*b* above handgrip portion 28*b*. Handle riser portion 12*b* further comprises a stabilizer receiver 14*b* laterally displaced from handgrip portion 28*b*. A gap 38*b* is between handgrip portion 28*b* and stabilizer receiver 14*b* and is preferably configured to enable insertion of one or more of an archer's fingers therethrough.

Stabilizer receiver 14*b* comprises a body 50 having a major longitudinal axis "B." Preferably, axis "B" is substantially parallel to longitudinal axis "X" of handle riser portion 12*b*. Body 50 comprises a first end 52 and a second end 54 longitudinally displaced from first end 52. Body 50 further comprises a slot 56 positioned between first end 52 and second end 54. Slot 56 is configured to permit variable positioning of an archery bow stabilizer 36*b* (shown in phantom view) received within stabilizer receiver 14*b*. In the shown preferred embodiment, slot 56 extends longitudinally between first end 52 and second end 54 and thus permits variable longitudinal positioning of stabilizer 36*b* engaged within stabilizer receiver 14*b*.

Body 50 comprises an elongated shoulder 70 provided substantially coextensively within elongated slot 56. Shoulder 70 is defined by opposed inwardly facing abutments 72 separated by a space 74. Space 74 has a sufficient width to slidably receive a threaded bolt 64*b* of archery bow stabilizer 36*b*. Abutments 72 comprise exposed surfaces which define bearing surfaces against which a predetermined size threaded nut 66 received by threaded bolt 64*b* can tightly bear for securing stabilizer 36*b* to stabilizer receiver 14*b*. Slot 56 defines locking wrench jaws 76 adjacent abutments 72 and adapted to slidably receive threaded nut 66 therebetween but prevent nut 66 from rotating within slot 56.

Slot 56 comprises a space above abutments 72 and between locking jaws 76, and further comprises space 74 between abutments 72. Slot 56 thus extends entirely through body 14*b*. The depth of abutments 72 within body 14*b* is illustrated to be about 15 percent of a transverse thickness of body 50. However, such depth is merely an example depth. As will be recognized by persons of ordinary skill in the art, the depth of abutments 72 can be varied to accommodate various thickness of nuts and various designs of archery bow stabilizers.

An alternative way of describing stabilizer receiver 14*b* is that receiver 14*b* comprises a body 50 and an archery bow stabilizer receiving system comprising slot 56 associated with body 50. The archery bow stabilizer receiving system permits displacement of an archery bow stabilizer 36*b* across a range of variable positions between first end 52 and second end 54. Further, the archery bow stabilizer receiving system permits continuous displacement of archery bow stabilizer 36*b* across the range of variable positions between first end 52 and second end 54.

Referring to FIGS. 7–8, a fourth embodiment of the present invention is illustrated with like numerals from the proceeding discussion of the preceding embodiments utilized where appropriate, with differences being indicated by the suffix "c" or with different numerals.

Archery bow 10*c* comprises a handle riser portion 12*c*. Handle riser portion 12*c* comprises a hand grip portion 28*c* and a shelf 30*c* above hand grip portion 28*c*. Handle riser portion 12*c* further comprises a stabilizer receiver 14*c* laterally displaced from handgrip portion 28*c*. A gap 38*c* is between handgrip portion 28*c* and stabilizer receiver 14*c* and is preferably configured to enable insertion of one or more of an archer's fingers therethrough.

Handle riser portion 12*c* defines a major longitudinal axis "X" and stabilizer receiver 14*c* comprises a body 100 having a major longitudinal axis "C". Axis "C" can be substantially non-parallel to longitudinal axis "X" of handle riser portion 12*b*, as shown.

Archery bow handle 12*c* comprises a body 102 having a first end 32*c* and a second end 34*c* longitudinally displaced from first end 32*c*. Stabilizer receiver 14*c* is preferably removably attached to handle body 102. In the shown preferred embodiment, stabilizer receiver 14*c* is removably attached to body 102 with a first support member 104. In the shown embodiment, first support member 104 is a threaded pin. Pin 104 can comprise, for example, a screw or bolt. Pin 104 extends through an orifice 106 of receiver body 100 and threadedly engages a threaded aperture 108 extending into handle body 102. Alternative constructions of for detachably connecting stabilizer receiver 14*c* to body 102 will be recognized by persons of ordinary skill in the art. Such alternative constructions could comprise, for example, constructing first support member 104 in the form of a clip configured to releasably engage at least a portion of body 102.

Orifice 106 preferably comprises a first section 110 having a first cross-sectional width and a second section 112 having a second cross-sectional width. The first cross-sectional width is greater than the second cross-sectional width. Accordingly, stabilizer receiver 14*c* comprises a shoulder 114 where first section 110 of orifice 106 meets second section 112 of orifice 106. Threaded pin 104 comprises a head 116 having a cross-sectional width which is less than the cross-sectional width of first section 110 and greater than the cross-sectional width of second section 112. Accordingly, head 116 seats against stabilizer receiver shoulder 114 when bolt 104 is tightly engaged within threaded aperture 108.

Stabilizer receiver body 100 and handle body 102 further comprise receptacles 118 and 120, respectively. A second support member 122 extends within both of receptacles 118 and 120. In the shown embodiment, second support member 122 is a pin, and receptacles 118 and 120 are configured as pin receptacles. Preferably, one of pin receptacles 118 or 120 will be formed to very tightly grasp pin 122 and the other of the pin receptacles 118 or 120 will be formed to relatively loosely grasp pin 122. Accordingly, pin 122 may be forced into the tightly grasping pin receptacle to effectively become integral with either stabilizer receiver body 100 or handle body 102. In the shown, preferred embodiment, pin receptacle 118 is a receptacle which holds pin 122 very tightly. Accordingly, once pin 122 is wedged within receptacle 118, pin 122 effectively becomes integral with stabilizer receiver body 100. Pin 122 may be held within stabilizer receiver body 100 with adhesive, if necessary. However, if pin receptacle 118 is made sufficiently tight, pin 122 can be retained within stabilizer receiver body 100 without such adhesive.

Pin 122 can impede rotation of stabilizer receiver 14*c* relative to handle body 12*c*. Accordingly, pin 122 may be considered a rotation stop connected to both stabilizer receiver 14*c* and handle body 102. Alternative rotation stops will be readily apparent to persons of ordinary skill in the art. Such alternative rotation stops could comprise, for example, a plate adhered to both stabilizer receiver 14*c* and handle riser 12*c*, or tape adhered to both stabilizer receiver 14*c* and handle riser 12*c*.

In the shown embodiment, second support member 122 is longitudinally displaced from first support member 104.

In some embodiments, pin 122 comprises longitudinally extending ridges. Such ridges aid in holding pin 122 within pin receptacles 118 and 120, particularly if complementary ridge-receiving orifices are formed within one or both of the pin receptacles 118 and 120.

Stabilizer receiver 14*c* further comprises an aperture 126 configured for receiving an archery bow stabilizer 36*c*. In the shown, preferred embodiment, aperture 126 is threaded and configured for receiving a threaded extension 64*c* of archery bow stabilizer 36*c*.

Stabilizer receiver 14*c* can further comprise at least one weight reducing slot 128 formed within receiver body 100. For instance, in the shown embodiment, stabilizer receiver 14*c* comprises two such weight reducing slots 128.

The embodiment of FIGS. 7 and 8 can alternatively be described as a stabilizer receiver system comprising a stabilizer receiver 14*c* detachably attached to a handle riser body 102. The stabilizer receiver system comprises a first pin 104 extending within a first orifice 106 in stabilizer receiver 14*c* and within a second orifice 108 in handle riser body 102. The stabilizer receiver system further comprises a second pin 122 extending from stabilizer receiver 14*c* to archery bow riser 12*c*. Second pin 122 extends from a third orifice 120 in riser body 102 to a fourth orifice 118 in stabilizer receiver body 100.

Referring to FIGS. 9–10, a fifth embodiment of the present invention is illustrated. In describing the fifth embodiment, like numerals from the proceeding discussion of the first four embodiments are utilized where appropriate, with differences being indicated by the suffix "d" or the different numerals.

Archery bow 10*d* comprises a construction very similar to the construction of archery bow 10*c* discussed above. A difference between archery bow 10*d* and archery bow 10*c* is in the construction of pin 122*d* and pin receptacles 118*d* and 120*d*. Pin 122*d*, unlike pin 122 (shown in FIG. 8) is threadedly engaged within pin receptacle 118*d*. Pin 122*d* can be, for example, a set screw.

Pin receptacle 118*d* preferably comprises a first section 130 having a first cross-sectional width and a second section 134 having a second cross-sectional width. The first cross-sectional width is greater than the second cross-sectional width. Accordingly, stabilize receiver body 100*d* comprises a shoulder 136 where first section 130 of receptacle 118*d* meets second section 134 of receptacle 118*d*. Further, second section 134 is threaded and configured for threadedly engaging threaded pin 122*d*. Threaded pin 122*d* comprises a head 138 which seats against stabilizer receiver shoulder 136 when threaded pin 122*d* is tightly engaged within threaded section 134.

Receptacle 120*d* can be threaded, but preferably is not. Rather, receptacle 120*d* preferably comprises a dimple in a surface of riser body 102*d*.

Referring to FIG. 10, stabilizer 14*d* and handle riser 12*d* preferably together comprise a stabilizer receiver system wherein stabilizer receiver 14*d* is detachably attached to handle riser body 102*d*, and rotatably adjustable relative to handle riser body 102*d*. As shown, handle riser 12*d* preferably comprises a plurality of orifices 108*d*, 119, 120*d* and 121 within body 102*d*. A first pin 104*d* extends through stabilizer receiver orifice 106*d* (shown in FIG. 9) and into riser body orifice 108*d*. First pin 104*d* is a connector for connecting stabilizer receiver 14*d* (shown in FIG. 9) to handle riser 12*d*. A second pin 122*d* extends through stabilizer receiver orifice 118*d* (shown in FIG. 9) and into an orifice 120*d* of riser body 102*d*. In the absence of pin 122*d*, stabilizer receiver 14*d* (shown in FIG. 9) can rotate about pin 104*d*. As stabilizer receiver 14*d* rotates about pin 104*d*, orifices 119, 120*d* and 121 are separately aligned with orifice 118*d* of stabilizer receiver 14*d*. Once an orifice 119, 120*d* or 121 is aligned, second pin 122*d* may be inserted through orifice 118*d* of stabilizer receiver 14*d* and into whichever of the orifices 119*d*, 120*d* or 121*d* is aligned to lock stabilizer receiver 14*d* into a position relative to riser body 120*d*. Thus, stabilizer receiver 14*d* is rotatably adjustable relative to riser body 120*d*. Such rotatable adjustment of stabilizer receiver 14*d* may be advantageous in adjusting the position of a stabilizer 126*d* received within stabilizer receiver 14*d* to suit an archer's preference.

Referring to FIG. 11, a sixth embodiment of the present invention is illustrated. In describing the sixth embodiment, like numerals from the proceeding discussion of the first five embodiments are utilized where appropriate, with differences being indicated by the suffix "e" or the different numerals.

Archery bow 10*e* comprises a construction very similar to the construction of archery bows 10*c* and 10*d* discussed above. A difference between archery bow 10*e* and the previously discussed archery bows is in the construction of second support member 122*e* and receptacle 120*e*. Support member 122*e* is a protuberance of stabilizer receiver body 100*e* and receptacle 120*e* is an indentation within riser body 102*e* configured for receiving support member 122*e*.

Support member 122*e* is illustrated as being forwardly displaced of receptacle 120*e* rather than within receptacle 120*e*. This is a view of stabilizer receiver 14*e* partially engaged with handle 12*e*. The view is utilized to clearly illustrate support member 122*e* and receptacle 120*e*. In practice, stabilizer receiver 14*e* would generally be fully engaged with handle 12*e*. In such fully engaged configuration, support member 122*e* would generally be tightly engaged within receptacle 120*e*. Such tight engagement of support member 122*e* within receptacle 120*e* can prevent stabilizer receiver 14*e* from undesirably rotating about first support member 104*e*.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. An archery bow handle defining a major longitudinal handle axis comprising:

a handle body;

a first end of the handle body;

a second end of the handle body longitudinally displaced from the first end;

a handgrip portion positioned longitudinally between the first and second ends and configured to be grasped by an archer's hand;

a stabilizer receiver displaced from the handgrip portion and configured to receive an archery bow stabilizer, the stabilizer receiver and the handgrip portion overlapping at a common longitudinal displacement from the first end, the stabilizer receiver being removably attached to the handle body; and a cavity between the stabilizer receiver and the handgrip portion, the cavity being sized to enable one or more of the fingers of the archer's hand to slide between the handgrip portion and the stabilizer receiver.

2. The archery bow handle of claim 1 further comprising:

a threaded aperture extending into the handle body;

an orifice extending through the stabilizer receiver; and a threaded pin extending through the orifice and threadedly engaging the threaded aperture to removably attach the stabilizer receiver to the handle body.

3. The archery bow handle of claim 1 further comprising:

a threaded aperture extending into the handle body;

an orifice extending through the stabilizer receiver, the orifice comprising a first section having a first cross-sectional width and a second section having a second cross-sectional width, the first cross-sectional width being greater than the second cross-sectional width, the stabilizer receiver comprising a shoulder where the first section meets the second section; and a threaded pin extending through the orifice and threadedly engaging the threaded aperture to removably attach the stabilizer receiver to the handle body, the threaded pin comprising a head, the head having a cross-sectional width which is less than the first cross-sectional width and greater than the second cross-sectional width, the head seating against the stabilizer receiver shoulder.

4. The archery bow handle of claim 1 further comprising a rotation stop connected to both the stabilizer receiver and the handle body and configured to impede rotation of the stabilizer receiver relative to the handle body.

5. The archery bow handle of claim 4 wherein the stabilizer receiver comprises a pin receptacle and the handle body comprises a pin receptacle and wherein the rotation stop is a pin received within both the pin receptacle of the stabilizer receiver and the pin receptacle of the handle body.

6. The archery bow handle of claim 1 further comprising:

a threaded aperture extending into the handle body;

a pin receptacle extending into the handle body;

a pin receptacle extending into the stabilizer receiver;

an orifice extending through the stabilizer receiver;

a threaded first pin extending through the orifice of the stabilizer receiver and threadedly engaging the threaded aperture; and a second pin within both the pin receptacle of the stabilizer receiver and the pin receptacle of the handle body.

7. The archery bow handle of claim 1 wherein the stabilizer receiver comprises a major longitudinal axis and wherein the major longitudinal axis of the stabilizer receiver and the major longitudinal axis of the archery bow handle are substantially non-parallel to one another.

8. The archery bow handle of claim 1 wherein the stabilizer receiver comprises a receiver body and at least one weight reducing slot formed within the receiver body.

9. The archery bow handle of claim 1 wherein the handgrip portion defines a forward direction in which an arrow would be launched, and wherein the stabilizer receiver is laterally displaced forwardly of the handgrip portion.

10. An archery bow comprising:

a handle defining a major longitudinal handle axis and comprising:

a handle body;

a first end of the handle body;

a second end of the handle body longitudinally displaced from the first end;

a handgrip portion positioned longitudinally between the first and second ends and configured to be grasped by an archer's hand;

a stabilizer receiver displaced from the handgrip portion and configured to receive an archery bow stabilizer, the stabilizer receiver and the handgrip portion overlapping at a common longitudinal displacement from the first end, the stabilizer receiver being removably attached to the handle body; and a cavity between the stabilizer receiver and the handgrip portion, the cavity being sized to enable one or more of the fingers of the archer's hand to slide between the handgrip portion and the stabilizer receiver;

a pair of limbs extending from the handle; and a bowstring joined to the limbs.

11. An archery bow handle comprising:

a handle body;

a threaded aperture extending into the handle body;

a stabilizer receiver removably attached to the handle body, the stabilizer receiver being configured to threadedly engage an archery bow stabilizer;

an orifice extending through the stabilizer receiver;

a threaded first pin extending through the orifice of the stabilizer receiver and threadedly engaging the threaded aperture; and a rotation stop connected to both the stabilizer receiver and the handle body and configured to impede rotation of the stabilizer receiver relative to the handle body.

12. The archery bow handle of claim 11 wherein the rotation stop is longitudinally displaced from the threaded first pin.

13. The archery bow handle of claim 11 wherein the stabilizer receiver comprises a pin receptacle and the handle body comprises a pin receptacle and wherein the rotation stop is a second pin received in both the pin receptacle of the stabilizer receiver and the pin receptacle of the handle body.

14. An archery bow handle comprising:

a handle body;

a threaded aperture extending into the handle body;

a stabilizer receiver removably attached to the handle body, the stabilizer receiver being configured to threadedly engage an archery bow stabilizer;

an orifice extending through the stabilizer receiver;

a threaded first pin extending through the orifice of the stabilizer receiver and threadedly engaging the threaded aperture;

a rotation stop connected to both the stabilizer receiver and the handle body and configured to impede rotation of the stabilizer receiver relative to the handle body; and wherein one of the stabilizer receiver and the handle body comprises a protuberance and the other of the stabilizer receiver and the handle body comprises an indentation, and wherein the rotation stop is the protuberance received within the indentation.

15. An archery bow comprising:

an archery bow handle comprising:

a handle body;

a threaded aperture extending into the handle body;

a stabilizer receiver removably attached to the handle body, the stabilizer receiver being configured to threadedly engage an archery bow stabilizer;

an orifice extending through the stabilizer receiver;

a threaded first pin extending through the orifice of the stabilizer receiver and threadedly engaging the threaded aperture; and a rotation stop connected to both the stabilizer receiver and the handle body and configured to impede rotation of the stabilizer receiver relative to the handle body;

a pair of limbs extending from the archery bow handle; and a bowstring joined to the limbs.

16. A stabilizer receiver comprising:

a receiver body;

an aperture extending into the receiver body and configured for receiving an archery bow stabilizer, a first orifice extending through the receiver body and configured for receiving a first pin;

a second orifice extending into the receiver body and configured for receiving a second pin; and at least one weight reducing slot formed within the receiver body.

17. A stabilizer receiver system comprising:

an archery bow riser having a riser body, the archery bow riser comprising a first orifice within the riser body;

a stabilizer receiver having a receiver body and configured for detachably attaching to the riser body, the stabilizer receiver comprising a second orifice within the stabilizer receiver body;

an archery bow stabilizer threadedly received within the stabilizer receiver:

a first pin extending within the first and second orifices; and a second pin extending from the stabilizer receiver to the archery bow riser.

18. The stabilizer receiver system of claim 17 wherein the first pin is threaded.

19. The stabilizer receiver system of claim 17 wherein the riser body comprises a third orifice and wherein the second pin is retained within the third orifice.

20. The stabilizer receiver system of claim 17 wherein the receiver body comprises a fourth orifice and wherein the second pin is retained within the fourth orifice.

21. The stabilizer receiver system of claim 17 wherein the second pin extends through the stabilizer receiver and is threadedly engaged with the stabilizer receiver.

22. A stabilizer receiver system comprising:

an archery bow riser having a riser body, the archery bow riser comprising a first orifice within the riser body;

a stabilizer receiver having a receiver body and configured for detachably attaching to the riser body, the stabilizer receiver comprising a second orifice within the stabilizer receiver body;

a first pin extending within the first and second orifices;

a second pin extending from the stabilizer receiver to the archery bow riser; and wherein the second pin is one piece with the stabilizer receiver.

23. A stabilizer receiver system comprising:

an archery bow riser having a riser body;

a stabilizer receiver having a receiver body and configured for detachably attaching to the riser body;

an archery bow stabilizer threadedly received within the stabilizer receiver;

a first support member extending from the stabilizer receiver body to the riser body, the first support member detachably coupling the stabilizer receiver to the archery bow riser; and a second support member extending from the stabilizer receiver body to the riser body, the second support member substantially preventing rotation of the stabilizer receiver body relative to the riser body.

24. The stabilizer receiver system of claim 23 wherein the first support member is a threaded pin threadedly engaged within at least one of the stabilizer receiver body or the riser body.

25. The stabilizer receiver system of claim 23 wherein the second support member is a pin engaged within both the stabilizer receiver body and the riser body.

26. A stabilizer receiver system comprising:

an archery bow riser having a riser body;

a stabilizer receiver having a receiver body and configured for detachably attaching to the riser body;

a first support member extending from the stabilizer receiver body to the riser body, the first support member detachably coupling the stabilizer receiver to the archery bow riser; and a second support member extending from the stabilizer receiver body to the riser body the second support member substantially preventing rotation of the stabilizer receiver body relative to the riser body;

wherein the second support member is a protuberance of one of the stabilizer receiver body or the riser body, wherein the other of the stabilizer receiver body or the riser body comprises an indentation for receiving said protuberance, and wherein said protuberance is configured to extend to within said indentation.

27. A stabilizer receiver system comprising:

an archery bow riser having a riser body and a plurality of orifices within the riser body;

a stabilizer receiver having a receiver body and configured for detachably attaching to the riser body, the stabilizer receiver comprising at least two orifices extending through the stabilizer receiver body;

a first pin extending through a first of the stabilizer receiver orifices and received within a first of the riser body orifices;

a second pin extending through a second of the stabilizer receiver orifices and received within a second of the riser body orifices; and the first pin being threadedly engaged by the first of the riser body orifices and the second pin being threadedly engaged by the second of the stabilizer receiver orifices.

28. The stabilizer receiver system of claim 27 wherein the first pin is not threadedly engaged by the first of the stabilizer receiver orifices and wherein the second pin is not threadedly engaged by the second of the riser body orifices.

29. A stabilizer receiver system comprising:

an archery bow riser having a riser body;

a stabilizer receiver having a receiver body and configured for detachably attaching to the riser body;

a first support member extending from the stabilizer receiver body to the riser body, the first support member detachably coupling the stabilizer receiver to the archery bow riser, the stabilizer receiver being rotatable about the first support member; and a second support member extending from the stabilizer receiver body to the riser body, the second support member substantially preventing rotation of the stabilizer receiver body relative to the riser body and thereby locking the stabilizer receiver into a position relative to the riser body;

wherein the second support member can lock the stabilizer receiver into more than one position relative to the riser body.

30. The stabilizer receiver system of claim 29 wherein the second support member is a pin engaged within both the stabilizer receiver body and the riser body.

31. The stabilizer receiver system of claim 29 wherein the second support member is a protuberance of one of the stabilizer receiver body or the riser body, wherein the other of the stabilizer receiver body or the riser body comprises an indentation for receiving said protuberance, and wherein said protuberance is configured to extend to within said indentation.

32. A stabilizer receiver system comprising:

an archery bow riser having a riser body and at least two orifices within the riser body, the at least two orifices comprising a second orifice and a third orifice;

a stabilizer receiver having a receiver body and configured for detachably attaching to the riser body, the stabilizer being configured for attachment to the riser body with a connector and comprising an orifice extending therethrough for receipt of a pin;

a connector connecting the stabilizer receiver to the riser body, the stabilizer receiver being rotatable about the connector, the stabilizer receiver orifice alternately aligning with the first and second of the at least two riser body orifices as the stabilizer receiver is rotated about the connector; and a pin extending through the second of the stabilizer receiver orifices and received within either the first or the second riser body orifice, the second pin impeding rotation of the stabilizer receiver about the connector.

33. The stabilizer receiver system of claim 32 wherein the connector is a threaded pin.

34. A stabilizer receiver system comprising:

an archery bow riser having a riser body and at least three orifices within the riser body;

a stabilizer receiver having a receiver body and configured for detachably attaching to the riser body, the stabilizer receiver comprising a first orifice extending through the stabilizer receiver body and a second orifice extending through the stabilizer receiver body;

a first pin extending through the first stabilizer receiver orifice and received within a first of the riser body orifices, the stabilizer receiver being rotatable about the first pin, the second stabilizer receiver orifice alternately aligning with a second and a third of the at least three riser body orifices as the stabilizer receiver is rotated about the first pin; and a second pin extending through the second stabilizer receiver orifice and received within either the second or the third riser body orifice, the second pin impeding rotation of the stabilizer receiver about the first pin.

35. The stabilizer receiver system of claim 34 wherein the first pin is threadedly engaged by the first of the riser body orifices and wherein the second pin is not threadedly engaged by either the second or third riser body orifices.

36. The stabilizer receiver system of claim 34 wherein the first pin is threadedly engaged by the first of the riser body orifices, wherein the second pin is threadedly engaged by the second stabilizer receiver orifice, and wherein the second pin is not threadedly engaged by either the second or third riser body orifices.

* * * * *